US007060222B2

(12) United States Patent
Sachs et al.

(10) Patent No.: US 7,060,222 B2
(45) **Date of Patent: *Jun. 13, 2006**

(54) INFILTRATION OF A POWDER METAL SKELETON OF SIMILAR MATERIALS USING MELTING POINT DEPRESSANT

(75) Inventors: Emanuel M. Sachs, Newton, MA (US); Adam M. Lorenz, Somerville, MA (US); Samuel Allen, Jamaica Plain, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 357 days.

This patent is subject to a terminal disclaimer.

(21) Appl. No.: 10/276,457

(22) PCT Filed: May 21, 2001

(86) PCT No.: PCT/US01/16427

§ 371 (c)(1),
(2), (4) Date: May 19, 2003

(87) PCT Pub. No.: WO01/90427

PCT Pub. Date: Nov. 29, 2001

(65) Prior Publication Data

US 2004/0009086 A1 Jan. 15, 2004

Related U.S. Application Data

(60) Provisional application No. 60/206,066, filed on May 22, 2000.

(51) Int. Cl.
*B22F 3/26* (2006.01)

(52) U.S. Cl. ..... 419/27; 419/54

(58) Field of Classification Search ..... 419/27, 419/54

See application file for complete search history.

(56) References Cited

U.S. PATENT DOCUMENTS

| | | | |
|---|---|---|---|
| 3,652,261 | A | 3/1972 | Taubenblat |
| 4,286,987 | A | 9/1981 | Matthews |
| 4,327,156 | A | 4/1982 | Dillon et al. |
| 4,455,354 | A | 6/1984 | Dillon et al. |
| 4,478,638 | A | 10/1984 | Smith, Jr. et al. |

(Continued)

FOREIGN PATENT DOCUMENTS

GB 613 041 A 11/1948

(Continued)

OTHER PUBLICATIONS

Banerjee, S., Oberacker, R., and Goetzel, C., "Experimental Study of Capillary Force Induced Infiltration of Compacted Iron Powders with Cast Iron," Modern Developments in Powder Metallurgy, vol. 16, Metal Powder Industries Federation: Princeton, NJ, pp. 209-244, 1984.

(Continued)

*Primary Examiner*—Daniel Jenkins
(74) *Attorney, Agent, or Firm*—Steven J. Weissburg

(57) ABSTRACT

An infiltrant is used to fill a metal powder skeleton. The infiltrant is similar in composition to the base powder, but contains a melting point depressant. The infiltrant will quickly fill the powder skeleton, then as the melting point depressant diffuses into the base powder, the liquid will undergo solidification and the material will eventually homogenize. This process allows more accurate control of dimensions in large parts with uniform or homogeneous microstructure or bulk properties.

57 Claims, 5 Drawing Sheets

U.S. PATENT DOCUMENTS

| | | | | |
|---|---|---|---|---|
| 4,705,203 | A * | 11/1987 | McComas et al. | 228/119 |
| 4,710,273 | A | 12/1987 | Okamoto | |
| 4,964,908 | A | 10/1990 | Greetham | |
| 4,971,755 | A | 11/1990 | Kawano et al. | |
| 5,236,032 | A | 8/1993 | Nukami et al. | |
| 5,509,555 | A | 4/1996 | Chiang et al. | |
| 5,745,834 | A | 4/1998 | Bampton et al. | |
| 5,791,397 | A | 8/1998 | Suzuoki et al. | |
| 5,848,349 | A | 12/1998 | Newkirk et al. | |
| 6,719,948 | B1 * | 4/2004 | Lorenz et al. | 419/27 |

FOREIGN PATENT DOCUMENTS

| | | |
|---|---|---|
| WO | WO 91/18122 | 11/1991 |

OTHER PUBLICATIONS

Carman, C., Flow of gases through porous media. Butterworths: London, pp. 8-13, 1956.

Messner, R. and Chiang, Y., "Liquid-Phase Reaction-Bonding of Silicon Carbide Using Alloyed Silicon-Molybdenum Melts," Journal of the American Ceramic Society, vol. 73, No. 5, pp. 1193-1200, 1990.

Scherer, G., "Theory of Drying," Journal of the American Ceramic Society, vol. 73, No. 1, pp. 3-14, 1990.

Sercombe, T., Loretto M., and Wu, X., "The Production of Improved Rapid Tooling Materials," Advances in Powder Metallurgy and Particulate Materials, pp. 3-25 to 3-36, Proceedings of the 2000 International Conference of Powder Metallurgy and Particulate Materials, May 30-Jun. 3, 2000. Metal Powder Industries Federation: Priceton, NJ.

Tanzilli, R. and Heckel, R., "Numerical Solutions to the Finite, Diffusion-Controlled, Two-Phase, Moving-Interface Problem (with Planar, Cylindrical, and Spherical Interfaces)," Transactions of the Metallurgical Society of AIME, vol. 242, pp. 2313-2321, Nov. 1968.

Thorsen, K., Hansen, S., and Kjaergaard, O., "Infiltration of Sintered Steel with a Near-Eutectic Fe-C-P Alloy," Powder Metallurgy International, vol. 15, No. 2, pp. 91-93, 1983.

Zhuang, H., Chen, J., and Lugscheider, E., "Wide gap brasing of stainless steel with nickel-base brazing alloys," Welding in the World, vol. 24, No. 9/10, pp. 200-208, 1986.

Zhuang, W. and Eagar, T., "Liquid infiltrated powder interlayer bonding: a process for large gap joining," Science and Technology of welding and Joining, vol. 5, No. 3, pp. 125-134, 2000.

Goetzel, Claus G., "Infiltration," ASM Handbook, vol. 7, Powder Metallurgy, pp. 551-566, 1984.

Landford, George, "High Speed Steel made by Liquid Infiltration," Materials Science and Engineering, 28, pp. 275-284, 1977.

Langford, George and Cunningham, Robert E., "Steel Casting by Diffusion Solidification", Metallurgical Transactions B, vol. 9B, pp. 5-19, Mar. 1978.

Banerjee, S., Oberracker, R., and Goetzel, C.G., "Mechanism of Capillary-Force Induced Infiltration of Iron Skeletons with Cast Iron", The International Journal of Powder Metallurgy & Powder Technology, vol. 20, No. 4, pp. 325-341, 1984.

Fleming, R. P. H., "Liquid Phase Sintering & Infiltration of Some Nickle Base Alloys Produced by P/M Techniques", Modern Developments in Powder Metallurgy, Proceedings of the 1980 International Powder Metallurgy Conference, vol. 12, pp. 439-451, 1981.

* cited by examiner

INFILTRATION OF A POWDER METAL SKELETON OF SIMILAR MATERIALS USING MELTING POINT DEPRESSANT

PRIORITY CLAIM

This claims priority to U.S. Provisional application No. 60/206,066, filed on May 22, 2000, the full disclosure of which is fully incorporated by reference herein.

GOVERNMENT RIGHTS

The United States Government has certain rights in this invention pursuant to the Office of Naval Research Award # N0014-99-1-1090, Research in Manufacturing and Affordability, awarded on Sep. 30, 1999.

BACKGROUND

Traditional manufacturing processes using powder metallurgy initially produce a near net shape part which is only 50–70% dense. These 'green' parts then undergo further processing to achieve full density and the desired mechanical properties. The densification is done either by lightly sintering and infiltrating with a lower melting temperature alloy or by a high temperature sintering alone. In the first method, the part's dimensional change is typically only ~1% making it suitable for fairly large (~0.5 m on a side) parts, but the resulting material composition will be a heterogeneous mixture of the powder material and the lower melting temperature infiltrant. Sintering the powder to full density will result in a homogeneous final material, but a part will undergo ~15% linear shrinkage if it starts out at 60% density. For this reason, full density sintering is typically only used for smaller (<5 cm on a side) parts.

In many critical applications (structural, aerospace, military), a material of homogeneous composition is preferable because of certification issues, corrosion issues, machinability, or temperature limitations that might be imposed by the lower melting point infiltrant. Further, designers of metal components are not accustomed to working with composites of heterogeneous composition, and so this creates a psychological barrier.

GOAL

The ability to create very large parts with homogeneous composition via powder metallurgy builds on all of the benefits of PM processing. The key here is in using an infiltration step to densify the green part without any significant dimensional change, but resulting in a final material with homogeneous composition. This allows fabrication of homogeneous net shape parts in a wide variety of sizes using solid freeform fabrication, metal injection molding, or other PM processes. There also exists the potential of matching an existing commercial material system.

SUMMARY

The general concept is to use an infiltrant to fill a powder skeleton, that is similar to the base powder, but contains a melting point depressant. The infiltrant will quickly fill the powder skeleton, then as the melting point depressant diffuses into the base powder, the liquid will undergo isothermal solidification and the material will eventually homogenize. This process will allow more accurate control of dimensions in large parts with uniform or homogeneous microstructure.

To further explain this concept, FIG. 2 shows the phase diagram for nickel and silicon, an example. At the upper left corner, we see that the addition of ~11 wt % silicon can decrease the melting point of nickel by over 300° C. Choosing an infiltration temperature of 1200° C., an infiltrant alloy with 10% silicon could infiltrate a pure nickel skeleton. After filling the void space in the skeleton, the silicon would diffuse into the skeleton until it reached a uniform composition. If the void space in the skeleton was ~40%, the homogenized material would contain ~4% silicon.

The success of such an infiltration requires the time scale of the infiltration to be much faster than the diffusion of the melting point depressant and the subsequent homogenization. There are various techniques that can enhance this tradeoff, but the selection of a material system has the greatest impact on the infiltration and diffusion rate.

DETAILED DISCUSSION

These and other features, aspects, and advantages of the present invention will become better understood with regard to the following description and accompanying drawings, where:

FIG. 1 schematically depicts a homogenizing infiltration concept;

Figure 1:
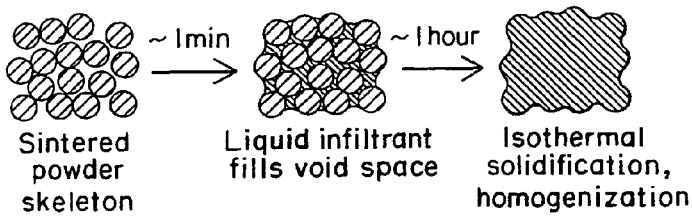
Figure 2:
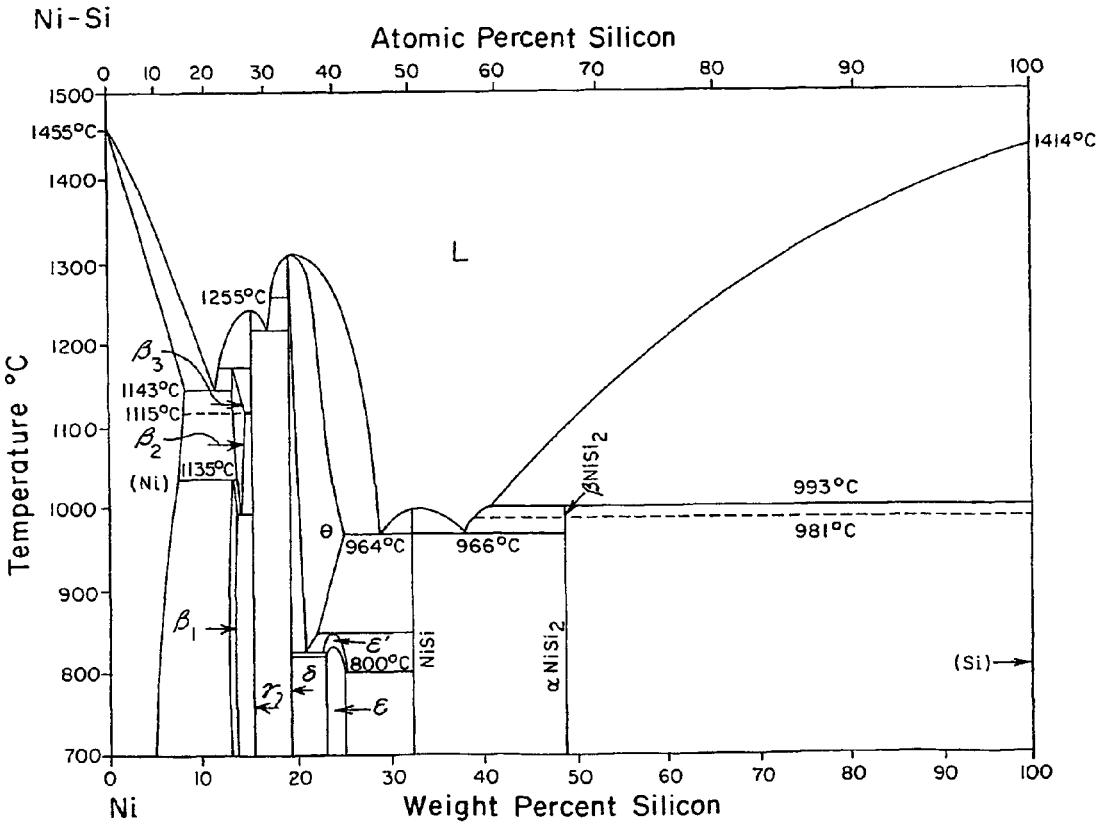
FIG. 2 is a Nickel-Silicon equilibrium phase diagram.

Transient liquid phase (TLP) brazing is commonly used to repair cracks and bond materials together. This traditional process involves the mechanism of a melting point depressant diffusing into a base material and undergoing isothermal solidification. Narrow gaps are necessary for the nickel brazing alloys to fill the capillary channel and solidify in a reasonable amount of time. The solidification time is limited by the diffusion of the melting point depressant into the base metal. Gaps wider than ~50 μm would result in excessively long solidification times.

Wide gap brazing has been developed to allow brazing of gaps in excess of 100 μm. Powder similar to the base material is used to fill the gap prior to the addition of the brazing alloy. This allows the liquid brazing alloy to fill large gaps and solidify faster.

There are two studies from the early 1980's involving the infiltration of a powder skeleton with the aim of creating a useful steel part. Banerjee attempted to use cast iron to infiltrate a skeleton of pure iron. The cast iron would freeze off within a few millimeters of contacting the skeleton due to the high diffusivity of carbon. Thorsen was successful in infiltrating a sintered steel skeleton with a Fe—C—P alloy, but an interconnected network of phosphides resulted in a very brittle final part.

SPECIFIC EXAMPLES

Infiltration of a pure nickel powder skeleton with any of the commercial nickel brazing alloys. The melting point depressants in the preexisting nickel brazes are phosphorous, boron, and silicon. The alloys also typically contain other elements that provide additional strength such as chromium, iron, molybdenum.

Infiltration of pure nickel powder skeleton with a binary alloy of nickel and silicon.

Infiltration of a nickel chromium skeleton with a nickel chromium silicon alloy.

Infiltration of a high melting temperature inconel alloy powder skeleton with a similar alloy containing a melting point depressant such as boron, phosphorous, silicon, tin or a combination thereof.

Infiltration of a pure aluminum or aluminum alloy skeleton with a similar alloy containing silicon or lithium as a melting point depressant.

Infiltration of a pure copper or copper alloy skeleton with a copper silver, copper titanium or other alloy with melting point depressed.

Details of Execution

Several techniques have been developed and used to overcome difficulties with diffusion occurring during the infiltration of a skeleton.

Gate Mechanism to Separate Molten Infiltrant from Skeleton

Physical separation of the liquid infiltrant from the skeleton prevents premature interaction or diffusion before the infiltration begins. If the infiltrant is already in physical contact with the skeleton prior to melting, the liquid will begin to wick into the part as soon as it becomes molten. In this case, the melting of the infiltrant or other transient thermal processes will control the infiltration rate. Controlling the introduction of the liquid can be done via a gate that can be actuated at a controlled point in time, once the liquid infiltrant has reached the desired steady state temperature. Several such gating mechanisms have been used in practice.

A simple method is to suspend the skeleton prior to infiltration and dip it into a bath of the molten infiltrant. If the part is too delicate to hang under its own weight, then a special mechanism should be used to allow a gated infiltration with the part resting in a crucible. It can be difficult to create a fluid seal that will hold at the infiltration temperature, but using a crucible material that is not wet by the infiltrant makes a seal possible. Two simple mechanisms have been used successfully so far. The first is a vertical alumina plate used to separate the two halves of a rectangular crucible. The shape of the plate must match the cross-sectional profile of the crucible, so a bisque fired alumina was cut and filed to maintain less than 1 mm gap when fitted to the crucible. This gap was sufficient to hold a 2 cm deep pool, but a deeper pool would require closer tolerances or filling of any gaps with a coarse alumina powder. A more elegant solution is to use an alumina tube with a cleanly cut end to sit vertically with the end flush with the bottom of the crucible. The infiltrant is placed inside the tube and will contain the melt until the tube is lifted from above.

Several other methods can be used for gating the infiltration. A custom crucible could be fabricated with a hole at the bottom. This hole could be plugged with a simple rod to prevent infiltrant flow until the rod is removed. Another method is to tip a container of infiltrant allowing the liquid to flow out of the tundish. Further, the vessel used to contain the infiltrant could be flexible. A woven cloth of alumina fibers has been used to contain liquid metal. A cloth bag could be used to contain the melt and then opened up to allow the liquid to flow out.

The actuation of any type of gate requires a linear or rotary motion actuator passing through the gas-tight shell of the furnace. In the case of nickel parts fired in a forming gas atmosphere, the feedthrough can be a rod sliding through a slightly oversized hole in the shell. If the internal pressure in the furnace is maintained to several inches of water, the leak will not allow air into the furnace to contaminate the atmosphere. In applications where atmosphere purity is more critical, several linear and rotary motion feedthroughs are available commercially for high vacuum applications.

Presaturation of the Melt

Figure 3:
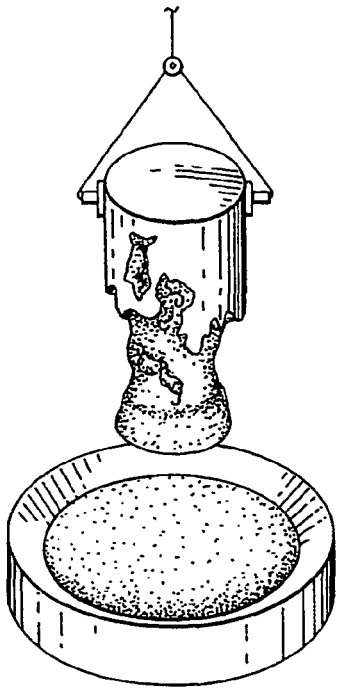
FIG. 3 shows dissolution of a pure nickel skeleton after dipping into a pool of Ni-11 wt % Si for 5 minutes at 1200° C.

If the liquid infiltrant has a composition that is greater than its equilibrium liquidus composition at a given temperature, it will have the capacity to absorb additional material from the skeleton and dissolve the part. This can happen very quickly because of the high diffusivity in liquids. It can be a significant problem especially when a large melt pool is used. FIG. 3 shows a pure nickel skeleton, originally a cylinder, with the bottom section dissolved from when it was dipped into a pool of molten Ni-11 wt % Si for 5 minutes at 1200° C. Since the equilibrium liquidus composition is less than 10% Si, the liquid absorbs any solid nickel with which it comes into contact.

If the infiltrant composition is known exactly, the process temperature could be selected to exactly match the liquidus temperature for that composition, but this requires very accurate process control. A more robust method for ensuring that the liquid is saturated, is to put it in contact with solid and allow it to reach its equilibrium composition for whatever process temperature it is at. The liquid must be in contact with the solid for a long enough time to reach equilibrium. This time will depend on the surface area of liquid solid interaction and mass transfer in the liquid, determined by diffusion and convection.

Figure 4:
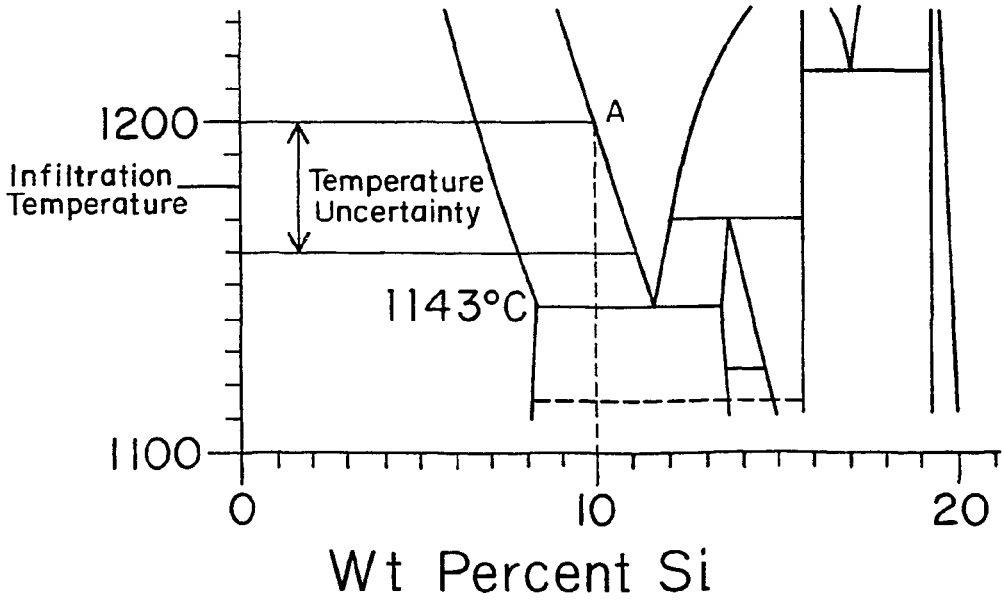
FIG. 4 shows schematically use of a phase diagram to calculate how much excess nickel to use in presaturating the infiltrant.
Figure 5:
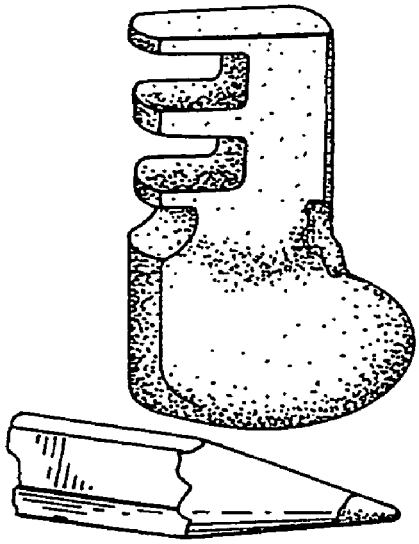
FIG. 5 shows an early part testing overhangs.

For example, to presaturate the nickel silicon infiltrant, excess nickel powder is added to the crucible of infiltrant. The large surface area of the powder enables equilibration in a reasonable amount of time. The amount of excess nickel added is important. Too little would result in it completely dissolving and the liquid still not reaching its equilibrium liquidus composition. Too much would result in solidification of the infiltrant pool. The appropriate amount is determined by considering the extreme cases for a window of processing temperatures. FIG. 4 illustrates how this would be done for a desired infiltration temperature of 1180° C. and maximum temperature variation of 20 degrees. The bulk composition should be chosen from the intersection of the maximum temperature with the liquidus line, marked as A on the figure. This ensures that there will be some solid present and all the liquid will be saturated with nickel. If the temperature is at the lower limit, this composition will correspond to a ratio of liquid to solid given by the Lever rule. For this example, at 10% Si and 1160° C. it would be approximately 30% solid. This will determine the amount of total infiltrant needed, since only 70% of the infiltrant is guaranteed to be liquid available for filling the part.

Example Infiltrations

There are several main considerations that are fundamental to successfully creating homogeneous parts via infiltration of a powder skeleton. Problems arise associated with premature freeze off of the infiltrant, erosion of the skeleton, and part distortion. This section addresses each of these issues by identifying probable causes and possible solutions.

Preventing Premature Freeze-Off of the Infiltrant Before it Fills the Skeleton

As was mentioned earlier, the time for the liquid to fill the skeleton must be significantly shorter than the time it takes for diffusion of the melting point depressant and the resulting isothermal solidification. If the alloying element diffuses too quickly, it will freeze off before the part has filled. Utilizing a gating mechanism during the infiltration as mentioned under details of execution is critical to minimizing the infiltration time. The other factors that control the infiltration rate are based on fluid mechanics.

The capillary force that draws the liquid into the skeleton is controlled by the surface tension of the liquid infiltrant. This force acts at the solid-liquid interface, which can be controlled by the powder size. Smaller powder will have a larger driving force proportional to 1/r. However, the smaller pore size will cause a larger restriction to the flow due to viscous drag. For flow through a cylindrical tube, the viscous drag is proportional to $1/r^2$. This means that infiltration should occur faster in a skeleton made from larger powder.

There will be a limit to the maximum powder size imposed by the necessary capillary rise height. If the pore space in the skeleton is modeled as a cylindrical channel of radius r, the driving force would be equal to $2\pi r \cdot \gamma_{st} \cdot \cos(\theta)$, where θ is the wetting angle. As the liquid rises, it must supports its own weight, equal to $\pi r^2 \cdot \rho g h$. The pore size radius must be small enough to yield a capillary rise greater than the height of a part. Using the value of surface tension for pure nickel at 1500° C. (1.7 N/m), assuming perfect wetting, and a part height of 0.5 meters, the pore radius must be less than 80 μm.

We have been able to measure some typical infiltration rates of the Ni-10Si infiltrant filling a 50–150 μm nickel skeleton. This was done through hanging the skeleton by a wire through the roof of the furnace and measuring the force increase on the wire. By isolating the surface tension and buoyancy forces, we were able to relate the force to the increasing mass of the part due to picking up the liquid. The liquid filled an 8 cm tall skeleton in approximately one minute. Other liquid metals have viscosity and surface tension that are similar so this rate should not change drastically with material system.

Now we move to discussion of the diffusion rate that will control the isothermal solidification of the infiltrant and the eventual homogenization of the skeleton. Since the liquid fills a small skeleton in approximately one minute, the isothermal solidification would ideally take place over an hour or two. The diffusion rate will be controlled primarily by the material system chosen. This was a reason for using Si as a melting point depressant in Ni rather than B or P, which diffuse faster. Diffusivity can have a strong dependence on temperature, since it is an activated process that follows an Arhennius dependence. Controlling infiltration temperature allows for some control of the diffusivity for a given material system. Reduced temperature should allow more time for the liquid to fill the skeleton before freezing.

In experimental tests, we have observed much faster mass transport than would correspond to the experimental values of diffusivity. It is possible that there is a reaction occurring at the solid liquid interface. For some material systems, the formation of a particular phase of intermetallic at the interface could accelerate the mass transport. The motion of the solid liquid interface could also be leaving behind solid that is high in composition of the melting point depressant.

Selection of a material system is critical to controlling the time scale of the isothermal solidification. In particular, the diffusivity of the melting point depressant will have the greatest effect on the freezing. Using a slower melting point depressant, such as tin, could drastically increase the amount of time the skeleton has to fill with infiltrant before freezing begins to occur.

Coating the powder skeleton (or just the raw powder) with some type of finite time diffusion barrier would keep the melting point depressant from leaving the infiltrant until the liquid has filled the part. Such a diffusion barrier could be another metal that has a lower diffusivity of solute. The thickness of the barrier could be selected so that it would only last for the duration of the infiltration. It would then allow the solute to diffuse through, allowing isothermal solidification and eventual homogenization.

Minimizing Erosion of the Skeleton

Figure 9:
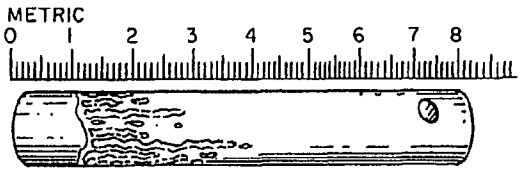
FIG. 9 shows schematically that erosion at the base of the skeleton progresses several centimeters into the part.

As the liquid infiltrant enters the skeleton, it has a tendency to leave an erosion path. This occurs to some extent in most powder metal infiltrations, but it usually is limited to the initial 1 cm at the base of a part. In those cases, the part to be infiltrated can be placed on top of a sacrificial stilt where the erosion occurs. In the nickel silicon system, the erosion tends to propagate for several centimeters into the part. The appearance is similar to a riverbed and one example is shown in FIG. 9. Studying the erosion pattern on several different parts suggest, not surprisingly, that the areas of highest liquid flow correspond to where the erosion occurs. Once erosion begins, the larger channel has less viscous drag and would allow more liquid to flow through the newly formed channel. An instability such as this would explain why the erosion progresses so far into the part. Through metallographic study of cross sections, the eroded areas are found to be high in silicon content. This is not surprising since those compositions would be liquid at the infiltration temperature. The areas of erosion are not limited to the surface, voids have been found within a part in a path of high silicon content.

Since the infiltrant was presaturated with nickel, it is surprising that more nickel is dissolved (erosion of the skeleton) as the liquid fills the part. Even if previously saturated, the infiltrant would have the capacity to absorb additional nickel if it increased in temperature. An exothermic reaction at the solid liquid interface could be generating heat and causing the erosion. The free energy of the solid at the homogenized composition is substantially lower than that of the initial heterogeneous system. Limiting the speed of that reaction could allow dissipation of the heat and minimize the erosion. This could be done by slowing down the flow of the infiltrant using some type of flow restriction.

Temperature control within the furnace could change the diffusion rate and the solubility of the infiltrant. A temperature variation with time as the part fills could compensate for heat generation within the part. Alternatively, a temperature gradient could be set up within the part. To gain insight into the formation of the erosion paths, visual inspection of the part during the infiltration would show when the erosion develops and how it grows.

Maintaining the Part's Initial Shape

Figure 6:
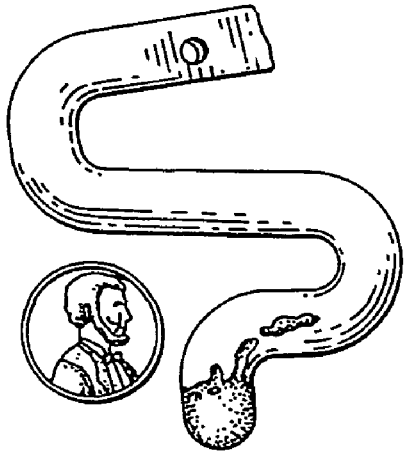
FIG. 6 shows a serpentine skeleton that was dipped in a bath and used to measure infiltration rate.
Figure 7:
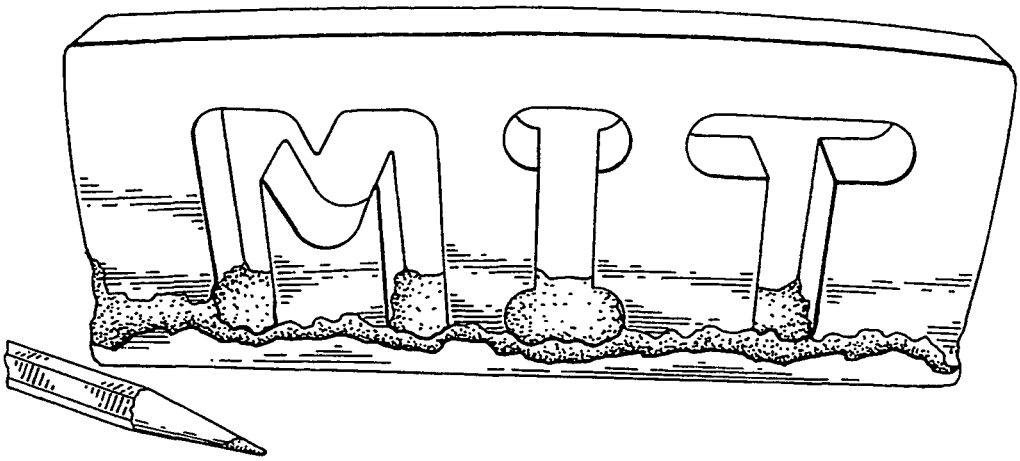
FIG. 7 shows a large (~1 kg) part infiltrated using a gate to prevent premature introduction of the infiltrant to the skeleton.
Figure 8:
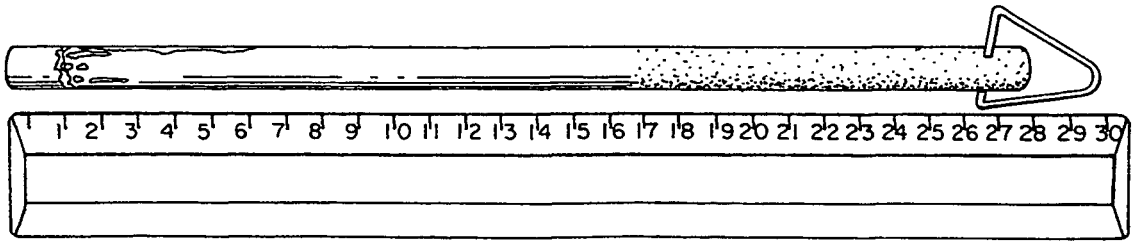
FIG. 8 shows a cylindrical skeleton that was infiltrated while hanging vertically to investigate limits to infiltration height; this particular sample filled ~16 cm.
Figure 10:
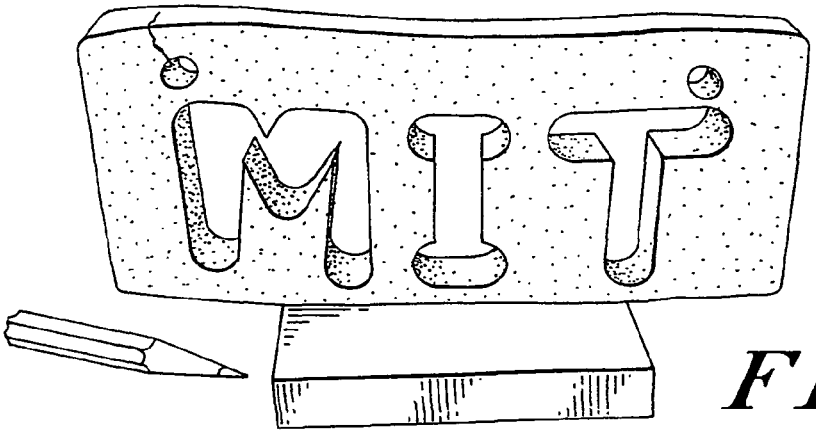
FIG. 10 shows a large MIT part that sagged after sintering, while suspended.
Figure 11:
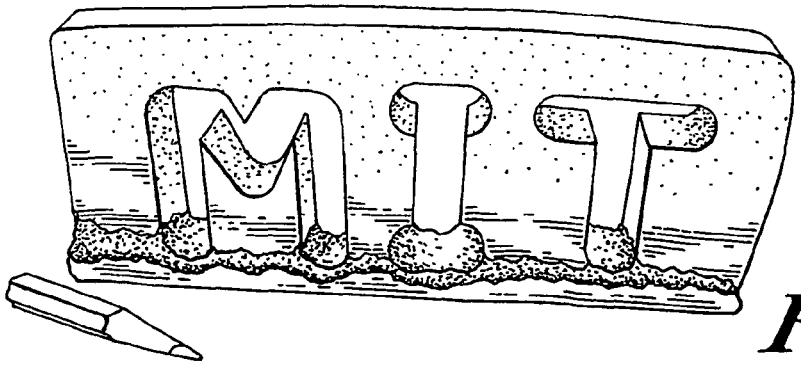
FIG. 11 shows a similar part as shown in FIG. 10, where the sagging problem was solved through allowing the part to rest on the crucible floor and using a different gating mechanism.

Since the processing is done at temperatures close to the melting point of the skeleton, the mechanical strength is very low. Part distortion was first encountered when suspending odd shaped parts above the melt. A mild manifestation of this can be seen in the serpentine part in FIG. 6. The top leg of the part was initially horizontal, but the bend widened while it was hanging. This happens during the high temperature sintering, prior to infiltration. The first step in minimizing the part distortion can be achieved either through changing the shape of the part or by supporting the part from beneath rather than suspending it. FIGS. 10 and 11 show how a large part that underwent distortion while hanging experienced little or no distortion while resting on the floor of a crucible. For intricate part shapes, this will not suffice. A loose ceramic powder can be filled around the metal part to support parts with intricate geometry. The infiltration can occur even while the part is embedded in ceramic, since the ceramic powder is not wet by the infiltrant.

In this homogenizing infiltration technique, the capillary body being filled is a powder skeleton, rather than a crack or narrow channel as is the case in known techniques for crack filling or brazing. This powder skeleton has been created as a net shape or near net shape part through a powder metallurgy process such as solid freeform fabrication or metal injection molding. Part size often dictates that the filling distance for the infiltrant is much greater than in traditional brazing applications. The corresponding bulk flow of infiltrant, especially through the entrance region, is quite large and can lead to erosion at the base of the part. Finally, the isothermal solidification and homogenization in a powder skeleton is different from in a narrow channel, with walls of semi-infinite thickness. The final composition of the part will be determined by the equilibrium composition of infiltrant and initial powder and their volume fractions.

Several techniques have been developed to overcome the challenges of a homogenizing infiltration. Gating the infiltration controls the time the liquid and solid are in contact with each other and prevent premature freezing. Several gating mechanisms are described and some have been successfully used in practice. Presaturation of the infiltrant is necessary to prevent excessive dissolution of the skeleton. Supporting the part in a bed of loose ceramic powder can prevent slumping of delicate parts, since the base material can soften at the infiltration temperature. A large skeleton should be filled with infiltrant prior to its isothermal solidification. Choice of materials, powder size and infiltration temperature can maximize the filling distance according to the relationships described. A coating can be applied to the powder to act as a diffusion barrier and slow down the solidification. The erosion of the skeleton could be caused by an exothermic reaction during the infiltration. Imposing a flow restriction would allow time for the generated heat to be dissipated and prevent the dissolution of the skeleton.

H. Zhuang, J. Chen and E. Lugscheider, "Wide gap brazing of stainless steel with nickel-base brazing alloys" *Welding in the World*. Vol. 24, No. 9/10, pp. 200–208 (1986)

S. Banerjee, R. Oberacker and C. G. Goetzel "Experimental Study of Capillary Force Induced Infiltration of Compacted Iron Powders with Cast Iron". *Modern Developments in Powder Metallurgy*. v 16. Metal Powder Industries Federation: Princeton, N.J. pp. 209–244 (1984)

K. A. Thorsen, S. Hansen and O. Kjaergaard, "Infiltration of Sintered Steel with a Near-Eutectic Fe—C—P Alloy," *Powder Metallurgy International*, Vol 15, No. 2, pp. 91–93 (1983)

Having described the invention, what is claimed, is:

1. A method for fabricating a substantially metal part, comprising the steps of:

a. providing a skeleton of nickel alloy powder material with voids throughout;

b. providing an infiltrant having a composition that comprises: said nickel alloy and a second material, said second material selected such that said infiltrant has a melting point temperature that is below the melting point temperature of said nickel alloy alone;

c. infiltrating said voids of said skeleton with said infiltrant in liquid form;

d. subjecting said infiltrated skeleton to temperature conditions such that said second material diffuses from said infiltrated voids into said nickel alloy powder material; and e. subjecting said infiltrated skeleton to temperature conditions such that infiltrant that has infiltrated into said voids, solidifies.

2. The method of claim 1, said step of subjecting said infiltrated skeleton to temperature conditions such that infiltrant solidifies, comprising maintaining said skeleton at a temperature that exceeds said melting temperature of said infiltrant.

3. The method of claim 2, said step of maintaining said infiltrated skeleton at a temperature that exceeds said melting point temperature of said infiltrant, comprising maintaining said infiltrated skeleton at substantially constant temperature, such that solidification occurs substantially isothermally.

4. The method of claim 1 said second material selected from the group consisting of silicon, phosphorous, tin and boron and combinations thereof.

5. The method of claim 1, said second material comprising silicon.

6. The method of claim 1, said step of providing a skeleton of nickel alloy powder comprising providing a skeleton of powder material having a particle size of between approximately 50 μm and approximately 150 μm.

7. The method of claim 1, said step of providing an infiltrant comprising providing a solution of silicon saturated with said nickel alloy.

8. The method of claim 7, said step of providing a solution of silicon saturated with said nickel alloy comprising providing a volume of liquid infiltrant, saturated with said nickel alloy, and further adding powder of said nickel alloy to said volume.

9. The method of claim 7, said step of infiltrating comprising infiltrating said skeleton at a temperature equal to or below a maximum expected infiltration temperature, and said step of providing an infiltrant comprising, providing a solution of silicon with said nickel alloy, having a bulk composition that is approximately equal to a bulk composition that corresponds with intersection, on an equilibrium phase diagram for said nickel alloy and silicon, of the liquidus line that includes zero percent silicon and a line at said maximum expected infiltration temperature.

10. The method of claim 1, said step of providing a skeleton comprising providing a skeleton having voids that form pores having a characteristic radius of less than approximately 80 μm.

11. The method of claim 1, said step of providing a skeleton comprising providing a skeleton having voids that form pores having a characteristic length of between approximately 0.08 m and approximately 0.5 m.

12. The method of claim 1, said step of providing a skeleton comprising providing a skeleton having voids that form pores having a characteristic length of between approximately 0.08 m and approximately 0.5 m and a characteristic radius of less than approximately 80 μm.

13. The method of claim 1, said step of infiltrating said voids of said skeleton with said infiltrant in liquid form comprising providing conditions such that said infiltrant substantially fully fills substantially all of said voids.

14. The method of claim 13, said step of providing conditions such that said infiltrant substantially fully fills substantially all of said voids comprising providing conditions such that said infiltrant substantially fully fills substantially all of said voids before said second material has diffused from said infiltrant to a degree sufficient to block additional infiltration.

15. The method of claim 1, said step of subjecting said infiltrated skeleton to temperature conditions such that said second material diffuses comprising subjecting said infiltrated skeleton to temperature conditions such that said second material diffuses from said infiltrated voids into and substantially throughout said nickel alloy powder material.

16. The method of claim 1, said step of providing an infiltrant comprising providing an infiltrant of which said second material has a diffusivity, relative to said nickel alloy powder material, that is high enough that said second material diffuses throughout said nickel alloy powder material.

17. A method for fabricating a substantially metal part, comprising the steps of:

a. providing a skeleton of nickel powder material with voids throughout;

b. providing an infiltrant having a composition that comprises: nickel and a second material, said second material selected such that said infiltrant has a melting point temperature that is below the melting point temperature of nickel alone;

c. infiltrating said voids of said skeleton with said infiltrant in liquid form;

d. subjecting said infiltrated skeleton to temperature conditions such that said second material diffuses from said infiltrated voids into said nickel powder material; and e. subjecting said infiltrated skeleton to temperature conditions such that infiltrant that has infiltrated into said voids, solidifies.

18. The method of claim 17, said step of subjecting said infiltrated skeleton to temperature conditions such that infiltrant solidifies, comprising maintaining said skeleton at a temperature that exceeds said melting temperature of said initial composition of said infiltrant.

19. The method of claim 18, said step of maintaining said infiltrated skeleton at a temperature that exceeds said melting point temperature of said infiltrant, comprising the step of maintaining said infiltrated skeleton at substantially constant temperature, such that solidification occurs substantially isothermally.

20. The method of claim 17 said second material selected from the group consisting of silicon, phosphorous, tin and boron and combinations thereof.

21. The method of claim 17, said infiltrant comprising silicon in an amount less than approximately 13% by weight and Nickel in an amount more than approximately 87% by weight, said percentages relating to only the Nickel and Silicon present, without regard to any other elements present in said infiltrant.

22. The method of claim 17, said second material comprising silicon, said step of subjecting said infiltrated skeleton to temperature conditions such that infiltrant that has infiltrated into said voids, solidifies, comprising the step of maintaining said skeleton at a temperature of between approximately 1150° C. and approximately 1400° C.

23. The method of claim 17, said step of infiltrating comprising infiltrating said skeleton at a temperature equal to or below a maximum expected infiltration temperature, and said step of providing an infiltrant comprising, providing a solution of silicon with nickel, having a bulk composition approximately equal to that which corresponds with intersection, on a nickel and silicon equilibrium phase diagram, of the liquidus line that includes zero percent silicon and a line at said maximum expected infiltration temperature.

24. The method of claim 17, said step of subjecting said infiltrated skeleton to temperature conditions such that said second material diffuses, comprising subjecting said infiltrated skeleton to temperature conditions such that said second material diffuses from said infiltrated voids into and substantially throughout said Nickel powder material.

25. A method for fabricating a substantially metal part, comprising the steps of:

a. providing a skeleton of nickel chromium powder material with voids throughout;

b. providing an infiltrant having a composition that comprises a nickel chromium silicon alloy, said infiltrant having a melting point temperature that is below the melting point temperature of nickel chromium alone;

c. infiltrating said voids of said skeleton with said infiltrant;

d. subjecting said infiltrated skeleton to temperature conditions such that silicon diffuses from said infiltrated voids into said nickel chromium powder material; and e. subjecting said infiltrated skeleton to temperature conditions such that infiltrant that has infiltrated into said voids, solidifies.

26. The method of claim 25, said second material selected from the group consisting of silicon, phosphorous, tin and boron and combinations thereof.

27. The method of claim 25, said step of providing a skeleton comprising providing a skeleton having voids that form pores having a characteristic radius of less than approximately 80 μm.

28. The method of claim 25, said step of providing a skeleton comprising providing a skeleton having voids that form pores having a characteristic length of between approximately 0.08 m and approximately 0.5 m.

29. The method of claim 25, said step of infiltrating said voids of said skeleton with said infiltrant in liquid form comprising providing conditions such that said infiltrant substantially fully fills substantially all of said voids.

30. The method of claim 29, said step of providing conditions such that said infiltrant substantially fully fills substantially all of said voids comprising providing conditions such that said infiltrant substantially fully fills substantially all of said voids before said second material has diffused from said infiltrant to a degree sufficient to block additional infiltration.

31. A method for fabricating a substantially metal part, comprising the steps of:

a. providing a skeleton of high temperature inconel alloy powder with voids throughout;

b. providing an infiltrant having a composition that comprises an alloy of said high temperature inconel alloy and a second material selected from the group consisting of boron, phosphorous, silicon, tin and a combination thereof, said infiltrant having a melting point temperature that is significantly below the melting point temperature of said high temperature inconel alloy alone;

c. infiltrating said voids of said skeleton with said infiltrant;

d. subjecting said infiltrated skeleton to temperature conditions such that said second material diffuses from said infiltrated voids into said inconel powder; and e. subjecting said infiltrated skeleton to temperature conditions such that infiltrant that has infiltrated into said voids, solidifies.

32. A method for fabricating a substantially metal part, comprising the steps of:

a. providing a skeleton of aluminum alloy powder material with voids throughout;

b. providing an infiltrant having a composition that comprises an alloy of said aluminum alloy and a second material selected from the group consisting of silicon and lithium and a combination thereof, said infiltrant having a melting point temperature that is below the melting point temperature of said aluminum alloy of said powder, alone;

c. infiltrating said voids of said skeleton with said infiltrant;

d. subjecting said infiltrated skeleton to temperature conditions such that said second material diffuses from said infiltrated voids into said aluminum alloy powder;

e. subjecting said infiltrated skeleton to temperature conditions such that infiltrant that has infiltrated into said voids, solidifies.

33. The method of claim 32, said step of subjecting said infiltrated skeleton to temperature conditions such that said second material diffuses comprising subjecting said infiltrated skeleton to temperature conditions such that said second material diffuses from said infiltrated voids into and substantially throughout said aluminum alloy powder material.

34. The method of claim 32, said step of infiltrating said voids of said skeleton with said infiltrant in liquid form comprising providing conditions such that said infiltratant substantially fully fills substantially all of said voids.

35. A method for fabricating a substantially metal part, comprising the steps of:

a. providing a skeleton of aluminum powder material with voids throughout;

b. providing an infiltrant having a composition that comprises an alloy of aluminum and a second material selected from the group consisting of silicon and lithium and a combination thereof, said infiltrant having a melting point temperature that is below the melting point temperature of aluminum alone;

c. infiltrating said voids of said skeleton with said infiltrant;

d. subjecting said infiltrated skeleton to temperature conditions such that said second material diffuses from said infiltrated voids into said aluminum powder; and e. subjecting said infiltrated skeleton to temperature conditions such that infiltrant that has infiltrated into said voids, solidifies.

36. A method for fabricating a substantially metal part, comprising the steps of:

a. providing a skeleton of copper alloy powder material with voids throughout;

b. providing an infiltrant having a composition that comprises an alloy of said copper alloy and a second material selected from the group consisting of silver and titanium, said infiltrant having a melting point temperature that is below the melting point temperature of said copper alloy of said powder, alone;

c. infiltrating said voids of said skeleton with said infiltrant;

d. subjecting said infiltrated skeleton to temperature conditions such that said second material diffuses from said infiltrated voids into said copper alloy powder; and e. subjecting said infiltrated skeleton to temperature conditions such that infiltrant that has infiltrated into said voids, solidifies.

37. The method of claim 36, said step of subjecting said infiltrated skeleton to temperature conditions such that said second material diffuses comprising subjecting said infiltrated skeleton to temperature conditions such that said second material diffuses from said infiltrated voids into and substantially throughout said copper alloy powder material.

38. The method of claim 36, said step of infiltrating said voids of said skeleton with said infiltrant in liquid form comprising providing conditions such that said infiltrant substantially fully fills substantially all of said voids.

39. A method for fabricating a substantially metal part, comprising the steps of:

a. providing a skeleton of copper powder with voids throughout;

b. providing an infiltrant having a composition that comprises an alloy of copper and a second material selected from the group consisting of silver and titanium, said infiltrant having a melting point temperature that is below the melting point temperature of copper alone;

c. infiltrating said voids of said skeleton with said infiltrant;

d. subjecting said infiltrated skeleton to temperature conditions such that said second material diffuses from said infiltrated voids into said copper powder; and e. subjecting said infiltrated skeleton to temperature conditions such that infiltrant that has infiltrated into said voids, solidifies.

40. A method for fabricating a substantially metal part, comprising the steps of:

a. providing a skeleton of metal powder material with voids throughout;

b. providing an infiltrant having a composition that comprises: said metal powder and a second material, said second material selected such that said infiltrant has a melting point temperature that is below the melting point temperature of said metal alone;

c. infiltrating said skeleton with said infiltrant by the steps of:

i. providing a vessel having a gate mechanism that divides said vessel into at least two regions, ii. placing said infiltrant in one of said regions;

iii. subjecting said infiltrant to a temperature that is greater than said melting point temperature of said infiltrant, for a time sufficient to melt said infiltrant;

iv. placing said skeleton in another of said regions; and v. activating said gate to allow said skeleton and said liquid infiltrant to contact each other at a location of said skeleton such that infiltrant is drawn into said voids of said skeleton, at least in part by capillary action;

d. subjecting said infiltrated skeleton to temperature conditions such that said second material diffuses from said infiltrated voids into said metal powder material; and e. subjecting said infiltrated skeleton to temperature conditions such that infiltrant that has infiltrated into said voids, solidifies.

41. The method of claim 40, further wherein said step of subjecting said infiltrated skeleton to temperature conditions such that said second material diffuses from said infiltrated voids into said metal powder material comprises subjecting said infiltrated skeleton to temperature conditions such that said second material diffuses from said infiltrated voids into and substantially throughout said metal powder material.

42. The method of claim 40, said gate mechanism comprising a movable divider between said first and second of said regions, said step of activating said gate comprising moving said gate sufficiently to allow said liquid infiltrant to contact said skeleton.

43. The method of claim 41, said gate mechanism comprising a movable tube having an end that is shaped to fit against a surface of said crucible, to close said tube, thereby dividing said vessel into one region within said tube, and another region outside said tube, said step of activating said gate comprising moving said tube away from said vessel wall sufficiently to allow said liquid infiltrant to flow out of said tube and to contact said skeleton.

44. The method of claim 40, said step of infiltrating said voids of said skeleton with said infiltrant in liquid form comprising providing conditions such that said infiltrant substantially fully fills substantially all of said voids.

45. A method for fabricating a substantially metal part, comprising the steps of:

a. providing a skeleton of metal powder material with voids throughout;

b. providing an infiltrant having a composition that comprises: said metal powder and a second material, said second material selected such that said infiltrant has a melting point temperature that is significantly below the melting point temperature of said metal alone;

c. infiltrating said skeleton with said infiltrant by the steps of:

i. providing a quantity of said infiltrant in liquid form;

ii. interposing a stilt between said skeleton and said liquid infiltrant, ii. contacting said stilt to said liquid infiltrant such that infiltrant is drawn into said voids of said skeleton, at least in part by capillary action, passing first through said stilt and then into said skeleton;

d. subjecting said infiltrated skeleton to temperature conditions such that said second material diffuses from said infiltrated voids into said metal powder material; and e. subjecting said infiltrated skeleton to temperature conditions such that infiltrant that has infiltrated into said voids, solidifies.

46. The method of claim 45, said step of subjecting said infiltrated skeleton to temperature conditions such that said second material diffuses comprising subjecting said infiltrated skeleton to temperature conditions such that said second material diffuses from said infiltrated voids into and substantially throughout said metal powder material.

47. The method of claim 45, said step of infiltrating said voids of said skeleton with said infiltrant in liquid form comprising providing conditions such that said infiltrant substantially fully fills substantially all of said voids.

48. A method for fabricating a substantially metal part, comprising the steps of:

a. providing a skeleton of metal powder material with voids throughout;

b. providing an infiltrant having a composition that comprises: said metal powder and a second material, said second material selected such that said infiltrant has a melting point temperature that is below the melting point temperature of said metal alone;

c. infiltrating said skeleton with said infiltrant by the steps of:

i. providing a quantity of infiltrant;

ii. subjecting said infiltrant to a temperature that is greater than said melting point temperature of said infiltrant, for a time sufficient to melt said quantity of infiltrant;

iii. suspending said skeleton above said quantity of said liquid infiltrant; and iv. bringing said skeleton and said infiltrant into contact so that said skeleton contacts said liquid infiltrant at a location of said skeleton such that infiltrant is drawn into said voids of said skeleton, at least in part by capillary action;

d. subjecting said skeleton to temperature conditions such that said second element diffuses from said infiltrated voids into said metal powder material; and e. subjecting said infiltrated skeleton to temperature conditions such that infiltrant that has infiltrated into said voids, solidifies.

49. The method of claim 48, said step of subjecting said infiltrated skeleton to temperature conditions such that said second material diffuses comprising subjecting said infiltrated skeleton to temperature conditions such that said second material diffuses from said infiltrated voids into and substantially throughout said metal powder material.

50. The method of claim 49, said step of infiltrating said voids of said skeleton with said infiltrant in liquid form comprising providing conditions such that said infiltrant substantially fully fills substantially all of said voids.

51. A method for fabricating a substantially metal part, comprising the steps of:

a. providing a skeleton of metal powder material with voids throughout;

b. filling a ceramic powder around said skeleton to a degree that will support said skeleton against slumping during subsequent steps at elevated temperature;

c. providing an infiltrant having a composition that comprises: said metal powder and a second material, said second material selected such that said infiltrant has a melting point temperature that is below the melting point temperature of said metal alone;

d. infiltrating said skeleton with said infiltrant by the steps of:

i. providing a quantity of infiltrant;

ii. arranging said infiltrant and said skeleton spaced apart from each other;

iii. subjecting said infiltrant to a temperature that is greater than said melting point temperature of said infiltrant, for a time sufficient to melt said quantity of infiltrant; and iv. contacting said skeleton to said melted infiltrant at a location of said skeleton such that infiltrant is drawn into said voids of said skeleton, at least in part by capillary action;

e. subjecting said infiltrated skeleton to temperature conditions such that said second element diffuses from said infiltrated voids into said metal powder material; and f. subjecting said infiltrated skeleton to temperature conditions such that infiltrant that has infiltrated into said void, solidifies.

52. The method of claim 51, said step of subjecting said infiltrated skeleton to temperature conditions such that said second material diffuses comprising subjecting said infiltrated skeleton to temperature conditions such that said second material diffuses from said infiltrated voids into and substantially throughout said metal powder material.

53. The method of claim 51, said step of infiltrating said voids of said skeleton with said infiltrant in liquid form comprising providing conditions such that said infiltrant substantially fully fills substantially all of said voids.

54. A method for fabricating a substantially metal part, comprising the steps of:

a. providing a skeleton of metal powder with voids throughout, said voids forming pores having a characteristic length of between approximately 0.08 m and approximately 0.5 m;

b. providing an infiltrant having a composition that comprises: said metal and a second material, said second material selected such that said infiltrant has a melting point temperature that is below the melting point temperature of said metal alone;

c. infiltrating substantially all of said voids of said skeleton substantially fully, with said infiltrant in liquid form;

d. subjecting said infiltrated skeleton to temperature conditions such that said second material diffuses from said infiltrated voids into said metal powder material; and e. subjecting said infiltrated skeleton to temperature conditions such that infiltrant that has infiltrated into said voids, solidifies.

55. The method of claim 54, said step of subjecting said infiltrated skeleton to temperature conditions such that said second material diffuses comprising subjecting said infiltrated skeleton to temperature conditions such that said second material diffuses from said infiltrated voids into and substantially throughout said metal powder material.

56. The method of claim 54, further comprising the step of selecting:

a. powder material having a granule representative size;

b. infiltrant having a viscosity;

c. infiltrant having a diffusivity in said powder material; and d. a finished part geometry having a maximum height;

such that said infiltrant infiltrates to a sufficient rate, to said maximum geometry height, before said second element has diffused out from said infiltrant that has infiltrated said voids to a degree that would result in said infiltrant solidifying and blocking off further infiltration.

57. The method of claim 56, said step of selecting comprising the step of adjusting at least one of the following factors as indicated:

a. decreasing said representative size of said powder material to achieve relatively greater maximum capillary driving rise height in said geometry;

b. increasing said representative size of said powder material to achieve a relatively faster rate of infiltration; and c. increasing said representative pore size of said skeleton to achieve a relatively longer period of time before solidification that blocks off further infiltration.

* * * * *